United States Patent [19]

Um

[11] 4,135,993

[45] Jan. 23, 1979

[54] RECOVERY OF LEAD VALUES

[75] Inventor: Richard T. Um, Mt. Prospect, Ill.

[73] Assignee: UOP Inc., Des Plaines, Ill.

[21] Appl. No.: 806,884

[22] Filed: Jun. 15, 1977

[51] Int. Cl.[2] ..... C01G 21/16; C25C 3/34

[52] U.S. Cl. ..... 204/66; 204/117; 423/98; 423/494

[58] Field of Search ..... 423/94, 98, 494; 204/66, 117

[56] References Cited

U.S. PATENT DOCUMENTS

| | | | |
|---|---|---|---|
| 984,525 | 2/1911 | Barstow | 423/494 |
| 1,950,000 | 3/1934 | Gamichon | 423/94 |
| 2,345,214 | 3/1944 | Pechukas | 423/494 |

*Primary Examiner*—Earl C. Thomas
*Assistant Examiner*—Wayne A. Langel
*Attorney, Agent, or Firm*—James R. Hoatson, Jr.; Raymond H. Nelson; William H. Page, II

[57] ABSTRACT

Lead values may be recovered from lead bearing sources such as lead sulfide in improved purity. The improved purity is obtained by subjecting soluble lead halides formed by the halogenation of lead sulfide and brine leaching the chlorinated product prior to treatment with a reducing agent followed by filtration and further treatment with an oxidizing agent whereby impurities as represented by other metal values are removed.

15 Claims, 1 Drawing Figure

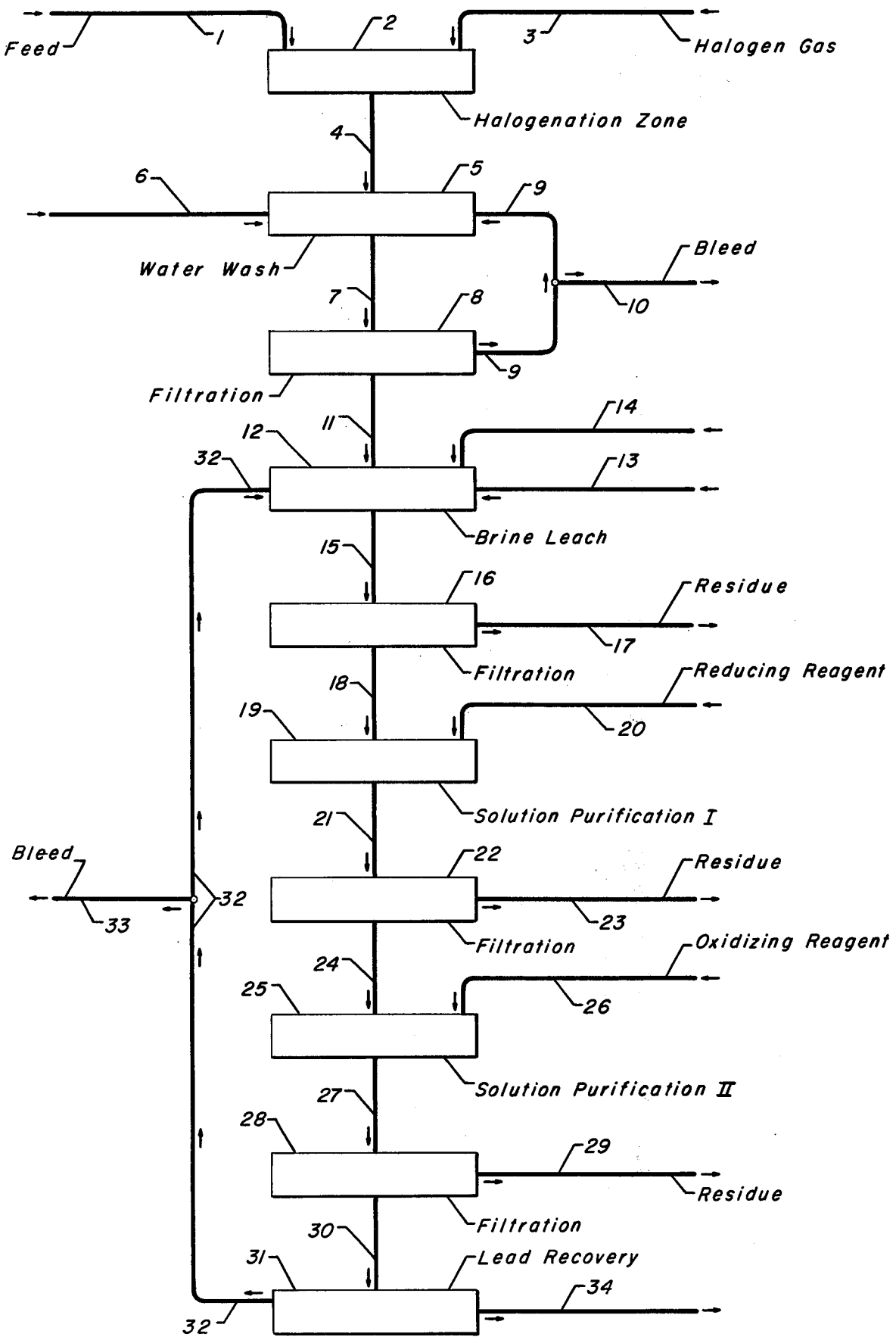
Feed
1
2
3
Halogen Gas
Halogenation Zone
4
5
6
9
Water Wash
Bleed
10
7
8
9
Filtration
11
14
12
32
13
Brine Leach
15
16
Residue
17
Filtration
18
Reducing Reagent
19
20
Solution Purification I
21
Bleed
22
Residue
32
33
23
Filtration
Oxidizing Reagent
24
25
26
Solution Purification II
27
28
29
Residue
Filtration
30
31
Lead Recovery
34
32

RECOVERY OF LEAD VALUES

BACKGROUND OF THE INVENTION

In standard methods of obtaining metallic lead from concentrates, the standard procedure has been to treat the lead sulfide concentrates in a blast furnace. However, the pyrometallurgical procedure possesses many disadvantages and drawbacks. Primary among these disadvantages is that the process will result in some major pollution problems such as the generation of sulfur oxide gas along with substantial fuming. The fuming carries with it possible carcinogenic compounds which will contain lead, cadmium, etc. Therefore, it is necessary to provide improved and safer methods for obtaining metals such as lead in metallic or elemental form by methods which will not contribute to pollution of the air or will be safer to operate. The aforementioned lead smelting techniques will consist of roast sintering the lead sulfide concentrate whereby a major portion of the sulfur will be removed followed by melting in a blast furnace to obtain the metallic lead.

In an effort to alleviate the pollution problem, it is necessary to develop new processes for obtaining lead which will be competitive as an alternative to the conventional smelting practices. Prior work in the hydrometallurgical field resulted in developing a non-aqueous processing route whereby lead sulfide concentrates are chlorinated at temperatures above 300° C. to produce lead chloride and volatilized sulfur. However, chlorination at these elevated temperatures will promote the formation of volatile chlorides of contaminating elements such as iron, magnesium, aluminum, silicon, zinc as well as elemental sulfur which may be present in the lead sulfide concentrate. Other hydrometallurgical processes which have been developed include the use of ferric sulfate as a leach agent. In this method, the lead sulfide is sulfated to form lead sulfate. This step is then followed by carbonation of the lead sulfate to form lead carbonate and thereafter the lead carbonate is subjected to dissolution in hydrofluosilicic acid for electrolysis to metallic lead. Yet another hydrometallurgical method which is developed for the recovery of lead is based on the use of a ferric chloride medium. This method involves a leaching step whereby the lead sulfide is converted to lead chloride and thereafter subjected to steps of solubilizing, crystallization, and electrolysis.

As will hereinafter be shown in greater detail, it has now been discovered that metallic lead in a relatively pure state may be produced in a simple and economical manner by a series of steps in which lead sources are halogenated, water washed, brine leached, and the resulting solution treated with a reducing agent and an oxidizing agent to remove any impurities which may still be present, thereby permitting the recovery of the desired lead in a purer state.

This invention relates to a hydrometallurgical process for the recovery of lead. More specifically the invention is concerned with an improvement in a process for obtaining metallic lead from lead sulfide sources or concentrates whereby a greater proportion of impurities which are present in the concentrate are removed, thereby leading to the production of a lead source which is in a purer form than has heretofore been obtainable.

It is therefore an object of this invention to provide an improved process for the production of lead values.

A further object of this invention is to provide a hydrometallurgical process for the production of relatively pure lead values from lead sulfide concentrates.

In one aspect an embodiment of this invention resides in a process for the recovery of lead values from a lead bearing source which comprises the steps of: (a) halogenating said lead bearing source at an elevated temperature, (b) washing the halogenated mixture, (c) leaching the washed mixture with brine, (d) filtering the resulting solution to separate elemental sulfur and residue from soluble lead halide, and (e) recovering the desired lead values, the improvement which comprises treating the soluble lead halide with a reducing agent, filtering to remove insoluble residue, thereafter further treating the soluble lead halide with an oxidizing agent and iron, and filtering the solution to remove insoluble residue before recovering said lead values.

A specific embodiment of this invention is found in a process for the recovery of lead values from a lead bearing source which comrises chlorinating said lead bearing source at a temperature in the range of from about 90° to about 120° C., water washing the chlorinated mixture, brine leaching the wash mixture at a temperature of from about 80° to about 120° C., filtering the resulting solution to separate elemental sulfur and residue from soluble lead chloride, treating said soluble lead chloride with a reducing agent comprising lead dust at a temperature in the range of from about 80° to about 120° C., filtering to remove insoluble residue, further treating the soluble lead chloride with an oxidizing agent and iron comprising air at a temperature in the range of from about 80° to about 120° C., filtering to remove insoluble residue, and recovering lead values by electrowinning the soluble lead chloride.

Other objects and embodiments will be found in the following further detailed description of the present invention.

As hereinbefore set forth the present invention is concerned with an improvement in a hydrometallurgical process for the production of metallic lead. The feed stock which is utilized for the present process will comprise a lead sulfide source in the form of either flotation concentrates or raw feed ores which are naturally rich in lead sulfide or complex sulfide ores containing lead, zinc, copper sulfides, etc., although it is contemplated that a portion of the lead may be present in the form of lead carbonate or lead oxide. The feed stock may be subjected to a drying step in order to remove any water which may be present in the lead bearing source in order that the material will remain in a fluid state during the processing and does not cake, and also that evolution of water will not occur during the subsequent halogenation step to an extent which is great enough to form significant quantities of a hydrogen halide such as hydrogen chloride, hydrogen bromide, hydrogen fluoride, etc., or other detrimental reaction products which could effect either the chemical or physical parameters of the process. After drying the feed stock at elevated temperatures which may range from about 100° to about 150° C. for a period of time which is sufficient to reduce the water content of the feed to a value of 2% or less, the dried feed is then subjected to halogenation. In contradistinction to prior art methods hereinbefore discussed, the present invention utilizes a halogenation temperature of the lead sulfide at relatively low values ranging from about 90° to about 120° C. The prior art methods such as the treatment of lead sulfide with a large excess of ferric chloride will give elemental sulfur and thus leave an excess of ferric chloride which is more corrosive in nature thus necessitating the use of more expensive equipment and, in addition, is not as selective in the chlorination of lead only, more impurity metals going into solution which will come over in the filtration step along with the soluble lead chloride. The halogenation of the lead sulfide is effected at this temperature of from 90° to about 120° C. by treating said lead sulfide with a halogenating compound such as chlorine, bromine, fluorine, etc. The halogenation of the lead sulfide with the aforementioned halogen gas will result in the formation of a lead halide such as lead chloride, lead bromide, or lead fluoride with the attendant formation of elemental sulfur.

The resulting halogenated mixture is then subjected to a wash whereby impurities such as the soluble metal halides will be removed prior to subjecting the mixture to a brine leaching operation. The wash solution may comprise water or aqueous solutions of calcium chloride, sodium chloride, ammonium chloride, etc. The washing of the halogenated mixture will remove such soluble metal chlorides as ferric chloride, copper chloride, zinc chloride, cadmium chloride, etc., whereby the lead which is eventually recovered will be in a purer form than that which has heretofore been obtained. The washing of the halogenated mixture may be effected over a relatively wide range of temperatures such as from about 5° to about 95° C., the amount of water or salt solution which is utilized for the washing step varying according to the amount of halogenated mixture. The wash solution is then separated from the solid halogenated mixture and charged to a treatment step whereby the wash water or salt solution may be treated for discharge or may also, if so desired, be treated for the recovery of the metallic impurities which have been removed and separated from the halogenated lead mixture. The solids are then leached by the addition of a brine solution at an elevated temperature usually in the range of from about 80° to about 120° C., said brine solution usually comprising an aqueous sodium chloride solution containing from about 20 to about 35% by weight of sodium chloride. During the brine leaching step, the pH of the solution is maintained in the range of from about 4 to about 6 by the addition of acidic or caustic solution such as the hydroxides of Group IA of the Periodic Table including sodium hydroxide, potassium hydroxide, lithium hydroxide, Group IIA of calcium, magnesium oxide or halogen acids such as hydrochloric acid, hydrobromic acid, etc. By controlling the pH of the brine leaching solution in the aforesaid range, other metallic impurities which are present in the solution such as copper, silver, zinc, cadmium, antimony and possibly iron along with some unreacted sulfides will reprecipitate from the solution either by hydrolysis or by reaction to form insoluble sulfides under the conditions of the solution. The leaching of the mixture is effected for a period of time which may range from about 0.25 to about 2 hours or more in duration, the residence time being that which is sufficient to dissolve the lead halide.

Upon completion of the leaching step, the solution is then subjected to a separation or filtration step in which the solid residue which comprises elemental sulfur as well as any solid gangue impurities are removed by separation from the soluble lead halide. The temperature during the filtration or separation step is also effected at elevated temperatures ranging from about 80° to about 120° C. whereby the lead halide is maintained in a soluble form. Thereafter the liquid portion of the separation is subjected to the action of a reducing agent which may include among others elemental lead in the form of lead dust, sodium sulfide, hydrogen sulfide, sulfur dioxide, etc. By subjecting the solution to a purification, it is possible to remove traces of metal impurities such as silver, copper, mercury or any other metals which are more noble in character than lead. If so desired, the step of solution purification by adding reducing reagent may be combined with the step of brine leaching of washed residue.

The resulting solution which has been treated with a reducing reagent of the type hereinbefore set forth, although it is also contemplated within the scope of this invention that any other compound which acts as a reducing agent may also be used, is then subjected to another filtration step whereby the solid residue which is formed by the reaction with the reducing agent is removed. Again the liquid portion is passed to a second solution purification step wherein the solution is subjected to the action of an oxidizing reagent. Examples of oxidizing agents which may be employed in this second purification step would include compounds such as chlorine gas, hydrogen peroxide, lead peroxide, sodium peroxide, potassium peroxide, potassium permanganate, sodium permanganate, air, oxygen, etc. In addition to the oxidizing agent, ferric iron is also added to the solution. In this second solution purification zone any traces of antimony, bismuth, arsenic, etc., will be removed with insoluble iron compounds while maintaining the pH of the solution at a value greater than about 3. The resulting solution is then subjected to a second separation or filtration step whereby the residue which is insoluble in nature due to the oxidation of the metal impurities is removed and the resulting solution which contains the still soluble lead halide is passed to a lead recovery step. It is to be noted that the temperature of the solution during the first purification step, filtration, second purification step and second filtration is maintained at an elevated range of from about 80° to about 120° C. in order to maintain the lead halide in soluble form.

The filtrate which is recovered may then be treated in either of two ways in order to recover lead values which are substantially pure and free from any metal impurities. One method of recovering the desired lead values is to pass the soluble lead halide to a crystallization zone wherein the soluble lead halide is crystallized due to a temperature drop, i.e., less than about 60° C., the solubility of the lead halide decreasing as the temperature decreases.

The thus crystallized lead halide is then recovered and, in the preferred embodiment of the invention, is dried to remove any trace of water which may still be present, the drying may be effected, if so desired, by placing the lead halide in an oven and subjecting the lead halide to a temperature of about 100° C. in an atmosphere of air for a period ranging from about 0.1 to about 4 hours or more, the duration of the drying period using that which is sufficient to remove all traces of water. Following the drying of the lead halide, it is then placed in an appropriate apparatus and subjected to a temperature sufficient to melt said halide until it assumes a molten form. This temperature may range from about 380° C. which is sufficient to melt lead bromide up to about 875° C. which is sufficient to melt lead fluoride. The lead halide in molten form is then admixed with a salt of a metal selected from the group consisting of alkali metals and alkaline earth metals. Examples of these salts of metals of Groups IA and IIA of the Periodic Table will include lithium chloride, sodium chloride, potassium chloride, rubidium chloride, cesium chloride, beryllium chloride, magnesium chloride, calcium chloride, strontium chloride, barium chloride, lithium bromide, sodium bromide, potassium bromide, rubidium bromide, cesium bromide, beryllium bromide, magnesium bromide, calcium bromide, strontium bromide, barium bromide, lithium fluoride, sodium fluoride, potassium fluoride, rubidium fluoride, cesium fluoride, beryllium fluoride, magnesium fluoride, calcium fluoride, strontium fluoride, barium fluoride, etc., in a fused salt bath. In the preferred embodiment, the salt of a metal of Groups IA or IIA of the Periodic Table will be comparable in the halide content to the lead halide which is to undergo electrolysis, that is, if the lead halide is lead chloride, the solid salt will comprise a chloride such as sodium chloride, potassium chloride, lithium chloride, calcium chloride, etc. In general, the salt of the metal of Groups IA or IIA of the Periodic Table will be present in the fused salt mixture in an amount in the range of from about 20% to about 40% by weight of the mixture. It is also contemplated within the scope of this invention that the lead halide will undergo electrolysis in the presence of a mixture of at least two salts of the metals of Groups IA and IIA of the Periodic Table, examples of these mixtures comprising a sodium chloride-lithium chloride mixture, a potassium chloride-lithium chloride mixture, a magnesium chloride-calcium chloride mixture, a lithium bromide-potassium bromide mixture, etc. In the fused salt bath the mixture of salts will be subjected to electrolysis utilizing a sufficient voltage to effect said electrolysis whereby metallic lead is deposited as a liquid which can be removed from the fused salt. The lead may be removed continuously or batchwise.

As an alternative method for the recovery of the desired lead values, the soluble lead chloride solution may be subjected to an aqueous electrowinning process whereby the lead is extracted from the lead chloride solution by electrolysis whereby the metallic lead is deposited out at the cathode of the cell.

The present invention will be further illustrated with reference to the accompanying drawing which illustrates a simplified flow diagram of the present process. Various valves, coolers, condensers, pumps, controllers, etc., have been eliminated as not being essential to the complete understanding of the present invention. The illustration of these, as well as other essential appurtenances will become obvious as the drawing is described.

Referring to the drawing, a charge stock of lead-containing concentrates such as that derived from Galena ores, etc., after being dried at an elevated temperature ranging from about 100° to about 150° C. whereby the water content of the ore is reduced to a value of 2% or less, is charged through line *1* to a halogenation zone 2. A halogenating agent such as chlorine gas, fluorine gas, bromine gas, etc., is charged through line 3 to halogenation zone 2 for a period of time sufficient to convert the lead sulfide to lead halide. The halogenation of the lead sulfide to lead halide is effected at a temperature in the range of from about 90° to about 120° C. In halogenation zone 2 the treatment of the lead sulfide with the halogenating agent is accomplished in such a manner as by stirring, mixing, shaking, fluidization, etc., whereby all of the lead sulfide is contacted with the halogenating agent. The resulting mixture of elemental sulfur and lead halide is then passed through line 4 to wash zone 5. The mixture is contacted in wash zone 5 with an influx of water or an aqueous salt solution of the type hereinbefore set forth through line 6 whereby impurities such as soluble metal halides include such compounds as iron chloride, copper chloride, zinc chloride, cadmium chloride, etc., along with the elemental sulfur and lead halide are passed through line 7 into filtration zone 8. The soluble portion of the solution is separated from the elemental sulfur and solid lead halide and removed through line 9 for recycle to wash zone 5, a portion of the recycle being bled through line 10 and removed. The solids comprising elemental sulfur and lead halide are then removed from filtration zone 8 through line 11 and passed to brine leaching zone 12. In leaching zone 12 the solid product is treated with an aqueous brine solution containing from about 20% to about 30% by weight of sodium chloride, the addition of the brine solution being accomplished by passing said brine solution into leaching zone 12 through line 13. The leaching step of this process is effected at elevated temperatures ranging from about 80° to about 120° C. In addition, the pH of the brine leaching solution is maintained in a range of from about 4 to about 6 during the leaching step by the addition of a caustic solution such as sodium hydroxide, potassium hydroxide, etc., or a hydrohalic acid such as hydrochloric acid, if required, through line 14. Upon completion of the leaching step, the mixture is passed through line 15 to a separation or filtration zone 16 whereby the soluble lead halide is separated from elemental sulfur as well as any solid gangue impurities. The separation of the soluble lead halide solution and the solid sulfur may be effected by filtration or by flotation and settling whereby, after allowing the solid residue containing elemental sulfur and/or impurities to settle, the liquid is removed by conventional means such as decantation, etc. The solid sulfur and residue are removed from filtration zone 16 through line 17 to a recovery zone, not shown in the drawings, wherein the residue which contains gangue, unreacted sulfides of the impurity metals such as zinc sulfide, copper sulfide and iron sulfide as well as elemental sulfur is subjected to a recovery treatment. The elemental sulfur may be separated from the impurities and recovered by any method known in the art, one example of such a recovery method which may be employed comprising froth flotation method in which the sulfur is preferentially floated. In addition, a scrubbing step to more fully liberate sulfur from the remainder of the residue may also be effected in the presence of a flotation promoter such as organic compounds readily available including kerosene, etc. The treated material is then transferred to a flotation cell, a frothing agent is added, aeration is initiated, and the sulfur-laden froth is removed from the cell. As an alternative method for the separation and recovery of elemental sulfur from impurities, the residue may also be treated with aqueous ammonium sulfide in which the ammonium polysulfide which is formed permits the recovery of elemental sulfur in a crystalline form. In like manner, the impurities comprising various metals which are present in the lead sulfide concentrate may also be recovered by conventional means such as cyanidation of the residue in a leaching operation to recover silver or other precious metals.

The solution which contains soluble lead halide such as lead chloride is removed from filtration zone 16 through line 18 and passed to a first solution purification zone 19. In this solution purification zone, the solution is subjected to the action of a reducing agent of the type hereinbefore set forth which is passed to solution purification zone 19 through line 20. It is to be noted that the temperature during the steps of brine leaching, filtration and both solution purifications as well as separation of the insoluble residues is maintained in a range of from about 80° to about 120° C. in order to maintain the lead halide in soluble form. After subjecting the solution to the action of the reducing agent, the resulting mixture is passed through line 21 to a separation or filtration zone 22 whereby the residue is separated from the soluble lead halide solution through line 23. The solution is then passed from filtration zone 22 through line 24 to a second solution purification zone 25. In this second solution purification zone the soluble lead halide in solution is subjected to the action of an oxidizing agent and elemental iron which are passed into zone 25 through line 26. After thorough admixing, the solution, which contains the soluble residue of impurity metals which have been oxidized, is withdrawn from solution purification zone 25 through line 27 to filtration zone 28 whereby the solid residue is removed through line 29 and the soluble solution passes through a line 30 to lead recovery zone 31. In lead recovery zone 31 the soluble lead halide solution may be subjected to an aqueous electrowinning process after stripping the brine leaching solution therefrom, said brine leaching solution which contains sodium chloride as well as any caustic material or acid being removed from lead recovery zone 31 through line 32 and recycled to leaching zone 12, a portion of the solution being bled off through line 33. Alternatively, the soluble lead halide solution may be passed through line 34 to a crystallization zone whereby the lead halide crystals will form due to a temperature drop and thereafter the crystals separated from the barren leach solution, said barren leach solution being recycled back to leaching zone 12 for further use therein. After separation of the lead halide crystals from the leach solution, the crystals may be passed to a drying zone such as an oven wherein all traces of water are removed by heating at an elevated temperature in excess of 100° C. for a predetermined period of time. The aforementioned dried lead halide crystals may then be removed from the drying zone and passed to a fused salt bath wherein said crystals are subjected to electrolysis in the presence of a salt of the type hereinbefore set forth. By effecting the electrolysis at an elevated temerature which is sufficient to maintain molten conditions, it is possible to remove and recover metallic lead from the fused salt electrolysis zone while the halogen molecules may be recycled, if so desired, back to the halogenation zone. It is to be noted that by utilizing such a flow system it is possible, after leaching the stoichiometric amount of halogen which is necessary to react with the lead sulfide, to reuse the halogen in a recycle or closed system thereby obviating the necessity of adding an additional amount of a halogen in any large quantities. This latter step will contribute to the lower cost of the overall process used in obtaining metallic lead from lead halide feed stocks.

While the above discussion has been descriptive of a continuous method of operating the process of the present invention, it is also contemplated that the recovery of metallic lead from a lead sulfide source may also be effected in a batch type of operation. When this type of operation is used, a quantity of the charge stock is placed in a drying apparatus such as an oven and subjected to a drying step at a temperature within the range hereinbefore set forth. Upon completion of the drying step, the charge stock is then placed in an appropriate apparatus and is thereafter subjected to the action of a halogenating agent. Inasmuch as the halogenation of the lead sulfide is exothermic in nature, the heat of reaction which is evolved will be controlled within the desired operating range hereinbefore set forth, although it is contemplated that heating or cooling means may be provided to stabilize the temperature of the reaction. Upon completion of the conversion of the lead sulfide to the desired halide, the halogenated product is then washed to dissolve any soluble metal halide compounds other than lead which may be present as impurities in the charge stock. The washed solid product is separated from the water by conventional means such as filtration, decantation, etc., and thereafter placed in an appropriate apparatus where it is subjected to the action of a brine leaching solution, the lead halide being solubilized. After agitating the solution for a predetermined period of time sufficient to dissolve the lead halide while maintaining the pH of the solution in a range of from about 4 to about 6 by the addition of a controlled amount of caustic solution or hydrohalic acid, if necessary, the soluble lead halide is separated from elemental sulfur and residue and is thereafter recovered. The filtrate is then placed in an apparatus and subjected to the action of a reducing agent while maintaining the temperature in the range of from about 80° to about 120° C. in order to maintain the lead halide in soluble form. Again the solid residue which results from the action of the reducing agent is separated from the liquid solution by conventional means following which the liquid solution is placed in another apparatus and subjected to the action of an oxidizng agent and iron while maintaining the temperature in the aforementioned range. After removal of the solid residue which results from the oxidizing reaction, the solution is then either cooled to crystallize out the lead halide compound followed by a molten salt bath electrolysis or subjected to an aqueous electrowinning process for the recovery of metallic lead.

The following examples are given for purposes of illustrating the process of this invention. However, these examples are given merely for purposes of illustration and are not intended to limit the generally broad scope of the present invention in strict accordance therewith.

EXAMPLE I

In this example 10 kilograms of a lead sulfide concentrate which is relatively high in antimony, zinc, copper, iron and silver impurities were reacted with 6.0 pounds of chlorine gas over a period of 5.4 hours while maintaining the temperature of the reactor between 93° and 101° C. Following this, the material was aged for an additional period of 1 hour at a temperature of about 85° C. An analysis of the lead concentrate before and after chlorination is set forth below:

| | Analysis, Weight % | | |
|---|---|---|---|
| Element | Before Chlorination | Post Chlorination | Conversion % |
| Lead | 67.8 | 54.4 | 98 |
| Iron | 5.45 | 4.41 | — |
| Copper | 0.72 | 0.78 | — |
| Zinc | 4.00 | 3.1 | — |
| Silver | 43.32* | — | — |
| Antimony | 0.30 | — | — |

-continued

| Element | Analysis, Weight % Before Chlorination | Post Chlorination | Conversion % |
|---|---|---|---|
| Bismuth | <0.10 | — | — |
| Sulfur | 17.8 | 14.6 | — |
| Chlorine | — | 21.0 | — |

*Ounces per ton

Following this, 30 grams of the chlorinated product were water washed by treatment with 150 cc of water for a period of 30 minutes at a temperature of 25° C. while maintaining the pH in the range of from 2.05 to 6.0. The filtrate of the water solution was analyzed with the following results:

| | 1 | 2 | 3 | 4 | 5 |
|---|---|---|---|---|---|
| Lead | | | | | |
| ppm | 2325 | 3350 | 1125 | 3175 | 2075 |
| Extraction % | 2.84 | 4.1 | 1.4 | 3.9 | 7.54 |
| Iron | | | | | |
| ppm | 2050 | 1950 | 645 | 1900 | 1800 |
| Extraction % | 31.0 | 29.5 | 6.7 | 28.7 | 27.2 |
| Zinc | | | | | |
| ppm | 875 | 875 | 400 | 925 | 800 |
| Extraction % | 18.8 | 18.8 | 8.6 | 20.0 | 17.2 |
| Copper | | | | | |
| ppm | 550 | 550 | 0 | 545 | 570 |
| Extraction % | 47 | 47 | 0 | 46.6 | 45.3 |

Following this, 100 cc of the filtrate from the water wash was subjected to a brine leaching using a 25% sodium chloride solution as the brine leach. Again 100 cc of the filtrate was analyzed after maintaining the pH in a range of from 4.7 to 5.9. The results are set forth in the following table:

| | 1 | 2 | 3 | 4 | 5 |
|---|---|---|---|---|---|
| Iron | | | | | |
| ppm | 110 | 140 | 15 | 160 | 110 |
| Extraction % | 0.8 | 1.0 | 0.1 | 1.2 | 0.8 |
| Zinc | | | | | |
| ppm | 50 | 31.3 | 75 | 37.5 | 62.5 |
| Extraction % | .5 | .3 | .80 | 0.40 | 0.7 |
| Copper | | | | | |
| ppm | 0 | 0 | 0 | 0 | 0 |
| Extraction % | 0 | 0 | 0 | 0 | 0 |

The filtrate or solution from the brine leach was then subjected to a purification step by treatment with lead dust. Analysis of the solution showed that it contained 10 parts per million of silver. To remove the silver 500 cc of the brine leach solution was treated for a period of 1 hour at a temperature of 100° C. with 200 milligrams of lead dust. The silver precipitated out during the test and it was found that after separation of the precipitate, the liquid portion which had contained 10 parts per million before treatment contained not more than 100 parts per million of silver and less than 10 parts per million of antimony after treatment with lead dust.

The liquid which contains lead chloride in solution along with other possible contaminants such as antimony, bismuth and arsenic may then be treated with iron and an oxidizing agent such as air by passage of air through the solution while maintaining the temperature at about 100° C. After a period of about 1 hour, the solution may be filtered to remove the precipitated impurities and the relatively pure lead chloride may be precipitated by passing said solution into a crystallization apparatus at a temperature below about 60° C. The precipitated lead chloride may then be admixed with sodium chloride followed by electrolysis, said electrolysis of the fused salts being effected at a temperature of about 550° C. using a voltage of 2.4 volts. The desired metallic lead may be recovered by tapping the electrolysis apparatus.

EXAMPLE II

In this example a lead sulfide concentrate which does not contain as high a percentage of contaminants such as antimony, zinc, iron, copper and silver was chlorinated by drying 10 kilograms of the concentrate in an oven at 110° C. for a period of 4 hours. The thus dried concentrate was then chlorinated by treatment at a temperature of about 95° C. for a period of 4.5 hours using 2400 grams of chlorine gas. The thus treated concentrate was aged for a period of 1.5 hours at 85° C. Analysis of the chlorinated product showed a weight percent of:

| | |
|---|---|
| Pb | 58.6% |
| Cu | 0.42% |
| Fe | 2.4% |
| Zn | 1.1% |

In addition, it was found that 95.0% of the lead was converted to lead chloride.

Thereafter four 50 gram portions of the lead chloride concentrate were water washed and the filtrate made up to 200 cc. The filtrate was analyzed with the following results:

| | 1 | 2 | 3 | 4 |
|---|---|---|---|---|
| Wash Water Vol. cc | 150 | 150 | 150 | 150 |
| Wash Temp, ° C. | 25 | 100 | 100 | 25 |
| Wash Water, NaCl % | 0 | 0 | 5 | 5 |
| Filtate Vol. cc | 200 | 200 | 200 | 200 |
| Filtrate pH | 2.2 | 3.9 | 4.1 | 2.6 |
| Pb conc. in Filtrate, ppm | 5000 | 4000 | 3500 | 3000 |
| Pb extraction in Filtrate, % | 3.4 | 2.7 | 2.4 | 2.0 |
| Fe conc. in Filtrate, ppm | 1800 | 750 | 340 | 1700 |
| Fe extraction in Filtrate, % | 30 | 12.5 | 5.6 | 28.3 |
| Zn conc. in Filtrate, ppm | 210 | 250 | 255 | 215 |
| Zn extraction in Filtrate, % | 7.6 | 9.1 | 9.3 | 7.8 |
| Cu conc. in Filtrate, ppm | 375 | 50 | 75 | 450 |
| Cu extraction in Filtrate, % | 35.7 | 4.8 | 7.1 | 43 |

The concentrate which was recovered from the water wash was then subjected to a brine leach using a 25% solution of sodium chloride, said leaching being effected at a temperature of 100° C. The filtrate from the brine leach after separation of elemental sulfur and gangue was analyzed with the following results:

| | 1 | 2 | 3 | 4 |
|---|---|---|---|---|
| Brine Leach Filtrate, cc | 300 | 300 | 300 | 300 |
| Brine Leach Filtrate, pH | 4.5 | 4.5 | 4.8 | 4.8 |
| Fe conc. in Filtrate, ppm | 14 | 10 | 12 | 12 |
| Fe extraction in Filtrate, % | 0.8 | 0.6 | 0.7 | 0.7 |
| Zn conc. in Filtrate, ppm | 4.6 | 6.0 | 2.8 | 3.8 |
| Zn extraction in Filtrate, % | 0.6 | 0.7 | 0.3 | 0.5 |
| Cu conc. in Filtrate, ppm | 0.0 | 0.0 | 0.0 | 0.0 |
| Cu extraction in Filtrate, % | 0.0 | 0.0 | 0.0 | 0.0 |

Following this the solution may then be subjected to a reducing reaction by treatment with 200 milligrams of lead dust while maintaining the temperature of the solution at about 100° C. for a period of 1 hour. Thereafter the residue which is formed by separation of silver and other impurities may then be separated from said residue and subjected to an oxidizing reaction wherein the solution is treated with an oxidizing agent such as sodium peroxide plus ferric iron while maintaining the temperature of the solution at about 80° to 120° C. for an additional period of about 1 hour. After separation of the solid impurities, the liquid which contains purified lead chloride in solution is then treated in a manner similar to that set forth in Example I whereby relatively pure metallic lead may be recovered by an electrolysis process.

I claim as my invention:

1. In a process for the recovery of lead values from a sulfur-containing lead bearing source which comprises the steps of:

(a) halogenating said lead bearing source at an elevated temperature to form lead halide,
(b) washing the halogenated mixture,
(c) leaching the washed mixture with brine,
(d) filtering the resulting solution to separate elemental sulfur and residue from soluble lead halide, and
(e) recovering the desired lead values, the improvement which comprises treating the soluble lead halide with a reducing agent, filtering to remove insoluble residue, thereafter further treating the soluble lead halide with an oxidizing agent and metallic iron and filtering the solution to remove insoluble residue before recovering said lead values.

2. The process as set forth in claim 1 in which the recovery of lead values is effected by crystallizing the lead halide and thereafter recovering metallic lead by fused salt electrolysis.

3. The process as set forth in claim 2 in which said electrolysis is effected utilizing a molten salt mixture.

4. The process as set forth in claim 3 in which said molten salt mixture is a sodium chloride-lead chloride mixture.

5. The process as set forth in claim 1 in which said halogenation is effected at a temperature in the range of from about 90° to about 120° C.

6. The process as set forth in claim 5 in which the halogenation of the lead bearing source is effected by treating said source with chlorine gas.

7. The process as set forth in claim 1 in which said leach of the wash mixture is effected at a temperature in the range of from about 80° to about 120° C.

8. The process as set forth in claim 1 in which said treatment with a reducing agent and the treatment with an oxidizing agent are both effected at a temperature in the range of from about 80° to about 120° C.

9. The process as set forth in claim 1 in which said reducing agent is lead dust.

10. The process as set forth in claim 1 in which said reducing agent is sodium sulfide.

11. The process as set forth in claim 1 in which said reducing gas is hydrogen sulfide.

12. The process as set forth in claim 1 in which said oxidizing agent is chlorine.

13. The process as set forth in claim 1 in which said oxidizing agent is hydrogen peroxide.

14. The process as set forth in claim 1 in which said oxidizing agent is air.

15. The process as set forth in claim 1 in which the recovery of lead values is effected by aqueous electrowinning the soluble lead halide.

* * * * *